US009739481B2

(12) United States Patent
Lang et al.

(10) Patent No.: US 9,739,481 B2
(45) **Date of Patent: *Aug. 22, 2017**

(54) VENTURI NOZZLE FOR A GAS COMBUSTOR

(71) Applicant: Flame Commander Corp., Lindale, TX (US)

(72) Inventors: Jerry M. Lang, Lindale, TX (US); David W. Scott, Rockwall, TX (US); Bradley C. Smith, Lindale, TX (US)

(73) Assignee: FLAME COMMANDER CORP., Lindale, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/210,997

(22) Filed: Jul. 15, 2016

(65) Prior Publication Data

US 2016/0327264 A1 Nov. 10, 2016

Related U.S. Application Data

(63) Continuation of application No. 14/810,079, filed on Jul. 27, 2015, now Pat. No. 9,416,966.

(Continued)

(51) Int. Cl.
*F23D 14/62* (2006.01)
*F23D 14/08* (2006.01)

(Continued)

(52) U.S. Cl.
CPC ..... *F23D 14/08* (2013.01); *F23C 9/00* (2013.01); *F23G 7/085* (2013.01);

(Continued)

(58) Field of Classification Search
CPC ... F23D 14/08; F23G 7/08; F23C 9/00; F23Q 7/00

(Continued)

(56) References Cited

U.S. PATENT DOCUMENTS 3,199,269 A 8/1965 Oehlrich et al.
3,547,567 A 12/1970 Turpin (Continued)

FOREIGN PATENT DOCUMENTS

EP 0540743 A1 5/1993
WO 2012078821 A2 6/2012

OTHER PUBLICATIONS

Korean Intellectual Property Office, International Search Report & Written Opinion for PCT/US2011/063848, published Sep. 20, 2012, 12 pages.

*Primary Examiner* — Gregory Huson
*Assistant Examiner* — Nikhil Mashruwala
(74) *Attorney, Agent, or Firm* — Daniel J. Chalker; Edwin S. Flores; Chalker Flores, LLP

(57) ABSTRACT

A venturi nozzle for a gas combustor includes an orificed gas nozzle, a venturi tube and one or more support members. The orificed gas nozzle has a longitudinal axis, an inlet and an outlet. The venturi tube is aligned with the longitudinal axis and has an entrance proximate to the outlet of the orificed gas nozzle and an exit. The support member(s) are attached between the orificed gas nozzle and the venturi tube to create a gap between the venturi tube and the orificed gas nozzle. In some embodiments, two or more venturi nozzles can be combined together in various configurations into a nozzle assembly or multi-nozzle gas combustor and attached, mounted or disposed within a stack, chimney or vented enclosure. The wall(s) of the stack, chimney or vented enclosure may include one or more openings, cut outs or vents to provide primary and secondary air to the venturi nozzles.

24 Claims, 5 Drawing Sheets

Related U.S. Application Data

(60) Provisional application No. 62/029,023, filed on Jul. 25, 2014.

(51) Int. Cl.
*F23G 7/08* (2006.01)
*F23C 9/00* (2006.01)
*F23Q 9/00* (2006.01)

(52) U.S. Cl.
CPC ..... *F23D 2203/007* (2013.01); *F23G 7/08* (2013.01); *F23Q 9/00* (2013.01)

(58) Field of Classification Search
USPC .... 431/202, 354, 190, 5; 110/211–214, 127; 126/39 E
See application file for complete search history.

(56) References Cited

U.S. PATENT DOCUMENTS

| | | | | |
|---|---|---|---|---|
| 3,554,681 | A | | 1/1971 | Proctor |
| 3,864,072 | A | | 2/1975 | Abernathy et al. |
| 3,994,671 | A | | 11/1976 | Straitz, III |
| 3,995,986 | A | | 12/1976 | Straitz, III |
| 4,105,394 | A | | 8/1978 | Reed et al. |
| 4,128,389 | A | | 12/1978 | Straitz, III |
| 4,130,388 | A | | 12/1978 | Flanagan |
| 4,130,888 | A | * | 12/1978 | Paul ..... G11C 19/0841 365/172 |
| 4,643,669 | A | | 2/1987 | Bozai |
| 4,856,985 | A | | 8/1989 | Ochel et al. |
| 4,913,646 | A | | 4/1990 | Backheim |
| 4,976,608 | A | | 12/1990 | Hyde |
| 5,195,884 | A | | 3/1993 | Schwartz et al. |
| 5,292,244 | A | | 3/1994 | Xiong |
| 5,405,420 | A | | 4/1995 | Yang |
| 5,478,232 | A | | 12/1995 | Dillinger et al. |
| 5,491,976 | A | | 2/1996 | Rock et al. |
| 5,567,390 | A | | 10/1996 | Cleary |
| 5,603,906 | A | | 2/1997 | Lang et al. |
| 5,681,160 | A | | 10/1997 | Ellis et al. |
| 5,688,115 | A | | 11/1997 | Johnson |
| 5,749,719 | A | | 5/1998 | Rajewski |
| 5,823,759 | A | | 10/1998 | Swinthenbank |
| 5,846,068 | A | | 12/1998 | Schwartz et al. |
| 5,937,770 | A | | 8/1999 | Kobayashi et al. |
| 6,383,461 | B1 | | 5/2002 | Lang |
| 6,383,462 | B1 | | 5/2002 | Lang |
| 6,638,059 | B1 | | 10/2003 | Mougey |
| 6,793,487 | B2 | | 9/2004 | Hubbauer et al. |
| 7,677,882 | B2 | | 3/2010 | Harless |
| 7,967,600 | B2 | | 6/2011 | Hong et al. |
| 8,096,803 | B2 | | 1/2012 | Mashhour et al. |
| 8,282,389 | B2 | | 10/2012 | Dhulst et al. |
| 8,337,197 | B2 | | 12/2012 | Poe et al. |
| 8,629,313 | B2 | | 1/2014 | Hong et al. |
| 8,652,234 | B1 | | 2/2014 | Lang et al. |
| 8,657,919 | B2 | | 2/2014 | Lang et al. |
| 2008/0081304 | A1 | | 4/2008 | Poe et al. |
| 2008/0153047 | A1 | | 6/2008 | Lee et al. |
| 2010/0236242 | A1 | | 9/2010 | Farsad et al. |
| 2010/0291492 | A1 | | 11/2010 | Poe et al. |
| 2015/0104752 | A1 | | 4/2015 | Lang et al. |
| 2016/0025336 | A1 | | 1/2016 | Lang et al. |
| 2017/0003021 | A1 | * | 1/2017 | Bacon ..... F23G 7/085 |

* cited by examiner

FIG. 1B
FIG. 1A
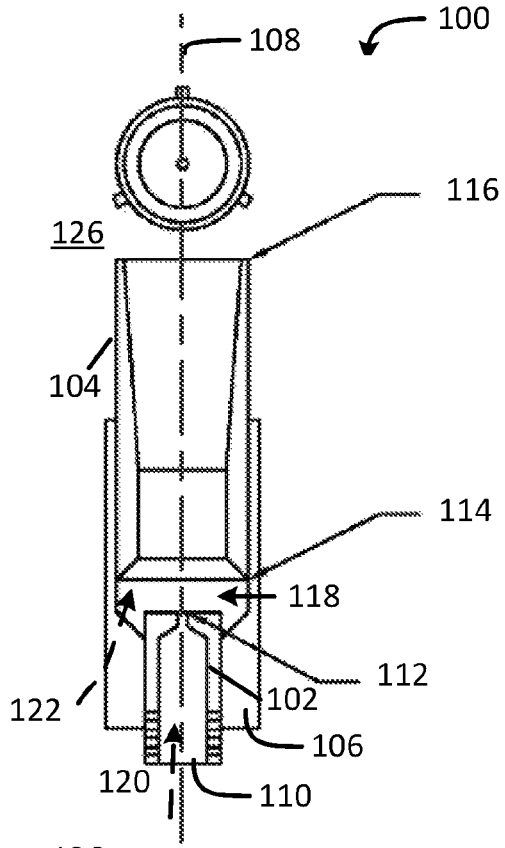
FIG. 2
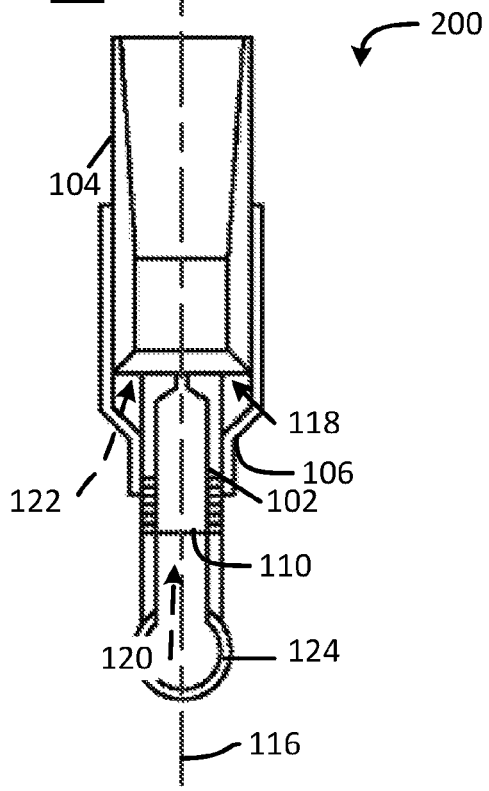

VENTURI NOZZLE FOR A GAS COMBUSTOR

CROSS-REFERENCE TO RELATED APPLICATIONS

This patent application is a continuation patent application of U.S. patent application Ser. No. 14/810,079 filed on Jul. 27, 2015 and entitled "Venturi Nozzle for a Gas Combustor", which is a non-provisional patent application of U.S. provisional patent application 62/029,023 filed on Jul. 25, 2014 and entitled "Venturi Nozzle for a Gas Combustor." The foregoing patent applications are hereby incorporated by reference in their entirety.

FIELD OF THE INVENTION

The present invention relates generally to the field of gas combustion devices and, more particularly, to a venturi nozzle for a gas combustor.

STATEMENT OF FEDERALLY FUNDED RESEARCH

None.

BACKGROUND OF THE INVENTION

Oil and gas production and refining operations produce gaseous emissions, which can be poisonous, malodorous, smokey, noisey and otherwise harmful to the environment. Over the years and especially more recently, governmental regulations require proper handling of these gaseous emissions while minimizing effects on the environment.

Accordingly there is a need for a venturi nozzle for a gas combustor.

SUMMARY OF THE INVENTION

The present invention provides a venturi nozzle for a gas combustor that includes an orificed gas nozzle, a venturi tube and one or more support members. The orificed gas nozzle has a longitudinal axis, an inlet and an outlet having a larger diameter than the inlet. The venturi tube is aligned with the longitudinal axis and has an entrance proximate to the outlet of the orificed gas nozzle and an exit. The one or more support members are attached between the orificed gas nozzle and the venturi tube to create a gap between an interior of the entrance of the venturi tube and an exterior of the outlet of the orificed gas nozzle.

In addition, the present invention provides a multi-nozzle gas combustor that includes two or more venturi nozzles and one or more manifolds or a gas chamber connected to the inlet of each orificed gas nozzle. Each venturi nozzle includes an orificed gas nozzle, a venturi tube and one or more support members. The orificed gas nozzle has a longitudinal axis, an inlet and an outlet having a larger diameter than the inlet. The venturi tube is aligned with the longitudinal axis and has an entrance proximate to the outlet of the orificed gas nozzle and an exit. The one or more support members are attached between the orificed gas nozzle and the venturi tube to create a gap between an interior of the entrance of the venturi tube and an exterior of the outlet of the orificed gas nozzle.

Moreover, in some embodiments two or more venturi nozzles can be combined together in various configurations into a nozzle assembly or multi-nozzle gas combustor and attached, mounted or disposed within a stack, chimney or vented enclosure. The wall(s) of the stack, chimney or vented enclosure may include one or more primary openings, cut outs or vents to provide primary air to the gap of the venturi nozzles, and one or more secondary openings, cut outs or vents to provide secondary air to outside the exit of the venturi tube to better complete combustion of the gas.

For example, a burner system can include a stack, chimney or vented enclosure having a top and a bottom, and a multi-nozzle gas combustor disposed within and proximate to the bottom of the stack, chimney or vented enclosure. The multi-nozzle gas combustor includes two or more venturi nozzles and one or more manifolds or a gas chamber connected to the inlet of each orificed gas nozzle. Each venturi nozzle includes an orificed gas nozzle having a longitudinal axis, an inlet and an outlet having a larger diameter than the inlet, a venturi tube aligned with the longitudinal axis and having an entrance proximate to the outlet of the orificed gas nozzle and an exit, and one or more support members attached between the orificed gas nozzle and the venturi tube that create a gap between an interior of the entrance of the venturi tube and an exterior of the outlet of the orificed gas nozzle.

The present invention is described in detail below with reference to the accompanying drawings.

BRIEF DESCRIPTION OF THE DRAWINGS

The above and further advantages of the invention may be better understood by referring to the following description in conjunction with the accompanying drawings, in which:

FIGS. 1A and 1B are top and side views of a venturi nozzle for a gas combustor in accordance with one embodiment of the present invention;

FIG. 2 a side view of a venturi nozzle for a gas combustor in accordance with another embodiment of the present invention;

DETAILED DESCRIPTION OF THE INVENTION

Figure 3A:
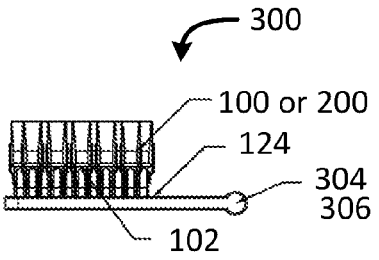
FIGS. 3A-3C are various views of two or more venturi nozzles combined together into a nozzle assembly or multi-nozzle gas combustor and attached, mounted or disposed within a stack, chimney or vented enclosure in accordance with one embodiment of the present invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention. The discussion herein relates primarily to combustors, but it will be understood that the concepts of the present invention are applicable to any type of burner.

Now referring to FIGS. 1A and 1B, a top and side view of a venturi nozzle 100 for a gas combustor in accordance with one embodiment of the present invention is shown. The venturi nozzle 100 includes an orificed gas nozzle 102, a venturi tube 104 and one or more support members 106. The orificed gas nozzle 102 has a longitudinal axis 108, an inlet 110 and an outlet 112 having a larger diameter than the inlet 110. The venturi tube 104 is aligned with the longitudinal axis 108 and has an entrance 114 proximate to the outlet 112 of the orificed gas nozzle 102 and an exit 116. The one or more support members 106 attach the orificed gas nozzle 102 to the venturi tube 104 to create a gap 118 between an interior of the entrance 114 of the venturi tube 104 and an exterior of the outlet 112 of the orificed gas nozzle 102. Note that the one or more support members 106 can be a tapered cylinder having two or more openings. The outlet 112 of the orificed gas nozzle 102 is separated and spaced apart from the entrance 114 of the venturi tube 104 along the longitudinal axis 108. A gas 120 exiting the outlet 112 of the orificed gas nozzle 102 provides a motive force that induces a flow of primary air 122 into the entrance 114 of the venturi tube 104. The flow of primary air 122 into the entrance 114 of the venturi tube 104 mixes with the gas 120 within the venturi tube 104. A pilot or igniter (not shown) can be disposed proximate to the exit 116 of the venturi tube 104. The primary air 122 and gas 120 mixture can be combined with a secondary air 126 outside the exit of the venturi tube 104 to better complete combustion of the gas 120. Alternatively, FIG. 2 shows a side view of a venturi nozzle 200 for a gas combustor in accordance with one embodiment of the present invention in which the outlet 112 of the orificed gas nozzle 102 is disposed within the entrance 114 of the venturi tube 104. The inlet 110 of the orificed gas nozzle 102 is attached to a manifold 124 that supplies the gas 120.

Figure 3B:
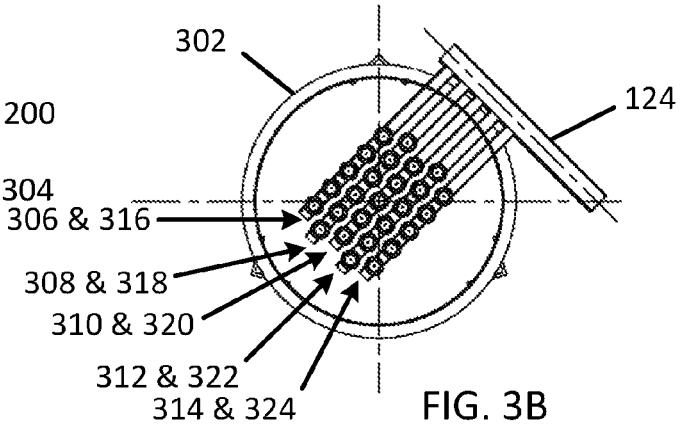
Figure 3C:
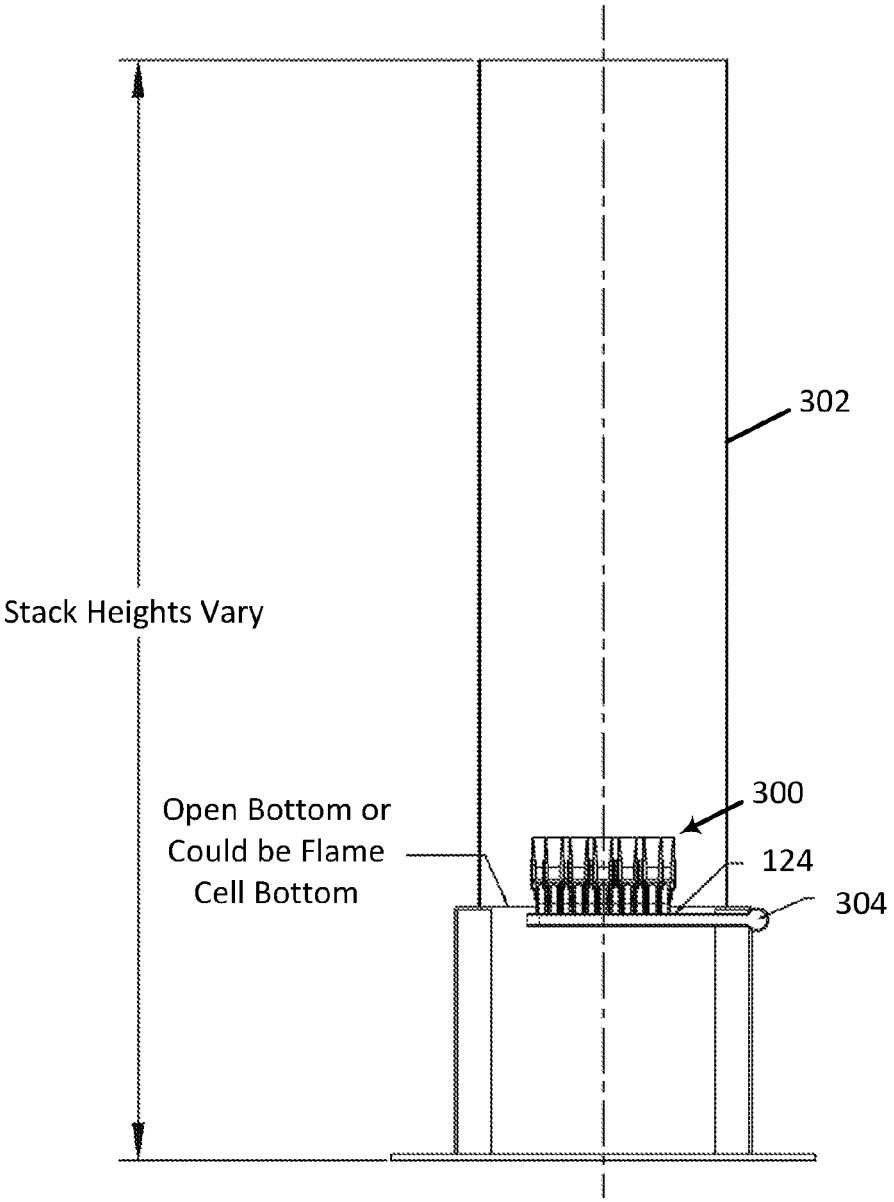

Referring now to FIGS. 3A-3C, two or more venturi nozzles 100 or 200 can be combined together into a nozzle assembly or multi-nozzle gas combustor 300 and attached, mounted or disposed within a stack, chimney or vented enclosure 302. As shown in FIG. 3C, the wall(s) of the stack, chimney or vented enclosure 302 may include one or more primary openings, cut outs or vents (not shown) to provide primary air 122 to the gap 118 of the venturi nozzles 100 or 200, and one or more secondary openings, cut outs or vents (not shown) to provide secondary air 126 to outside the exit of the venturi tube 104 to better complete combustion of the gas 120. As shown in FIGS. 3A-3B, the nozzle assembly 300 includes one or more manifolds 124 connected to the inlet 110 of each orificed gas nozzle 102. As shown, a main manifold 304 is connected to the one or more manifolds, which include a first branch manifold 306, a second branch manifold 308, a third branch manifold 310, a fourth branch manifold 312, and a fifth branch manifold 314. All the branch manifolds 306-314 are connected to the main manifold 302 and are substantially equally spaced apart and parallel to one another. The two or more venturi nozzles 100 or 200 include a first set of venturi nozzles 316 connected to the first branch manifold 306, a second set of venturi nozzles 318 connected to the second branch manifold 308, a third set of venturi nozzles 320 connected to the third branch manifold 310, a fourth set of venturi nozzles 322 connected to the fourth branch manifold 312, and a fifth set of venturi nozzles 324 connected to the fifth branch manifold 314. The first set of venturi nozzles 316, the third set of venturi nozzles 320 and the fifth set of venturi nozzles 322 each contain five venturi nozzles 100 or 200 that are equally spaced apart from one another. The second set of venturi nozzles 316 and the fourth set of venturi nozzles 318 each contain six venturi nozzles 100 or 200 that are equally spaced apart from one another and offset from the first set of venturi nozzles 316, the third set of venturi nozzles 310 and the fifth set of venturi nozzles 324. A pilot light or igniter (not shown) may be attached, mounted or disposed on the the nozzle assembly 300. Other venturi nozzle configurations can be used as will be appreciated by those skilled in the art.

Figure 4A:
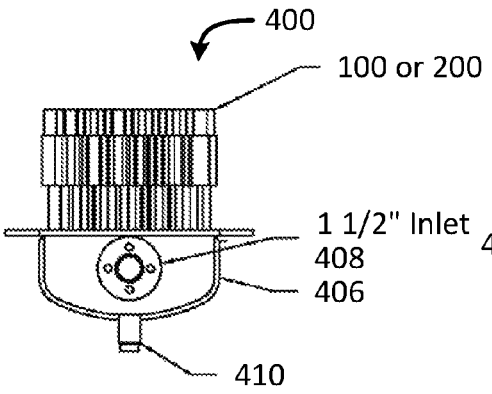
FIGS. 4A-4D are various views of two or more venturi nozzles combined together into a nozzle assembly or multi-nozzle gas combustor and attached, mounted or disposed within a stack, chimney or vented enclosure in accordance with another embodiment of the present invention.
Figure 4B:
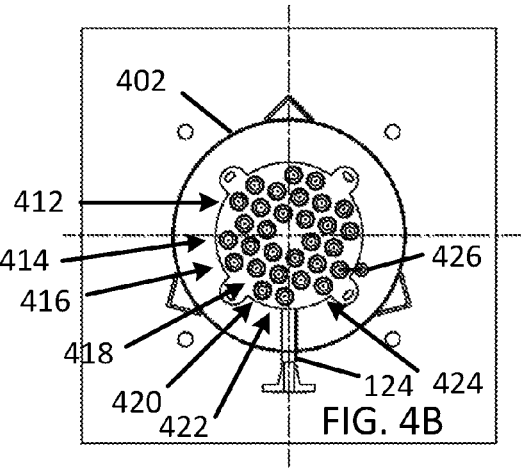
Figure 4C:
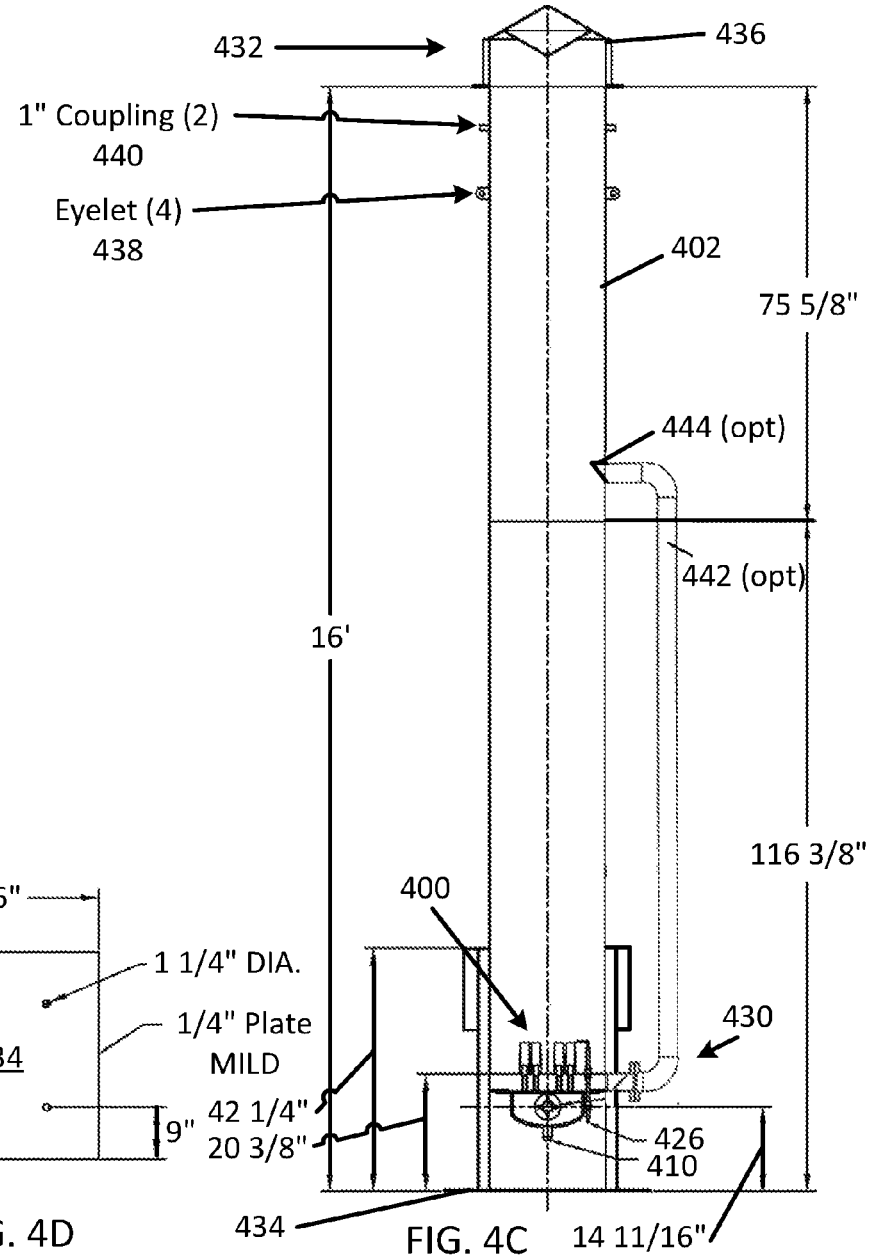

Now referring to FIGS. 4A-4D, two or more venturi nozzles 100 or 200 can be combined together into a nozzle assembly or multi-nozzle gas combustor 400 and attached, mounted or disposed within a stack, chimney or vented enclosure 402. As shown in FIG. 4C, the wall(s) of the stack, chimney or vented enclosure 402 may include one or more primary openings, cut outs or vents (not shown) to provide primary air 122 to the gap 118 of the venturi nozzles 100 or 200, and one or more secondary openings, cut outs or vents (not shown) to provide secondary air 126 to outside the exit of the venturi tube 104 to better complete combustion of the gas 120. As shown in FIG. 4A, the nozzle assembly 400 includes a gas chamber 406 connected to the inlet 110 of each orificed gas nozzle 102. The gas chamber 406 has a gas inlet 408 and a drain 410. As shown in FIGS. 4A and 4B, the two or more venturi nozzles 100 or 200 include a first set of venturi nozzles 412 connected to gas chamber 406, a second set of venturi nozzles 414 connected to the gas chamber 406, a third set of venturi nozzles 416 connected to the gas chamber 406, a fourth set of venturi nozzles 418 connected to the gas chamber 406, a fifth set of venturi nozzles 420 connected to the gas chamber 406, a sixth set of venturi nozzles 422 connected to the gas chamber 406 and a seventh set of venturi nozzles 424 connected to the gas chamber 406. The first set of venturi nozzle 412 and the seventh set of venturi nozzles 424 each contain two venturi nozzles 100 or 200 that are equally spaced apart from one another. The second set of venturi nozzles 414 and the sixth set of venturi nozzles 422 each contain five venturi nozzles 100 or 200 that are equally spaced apart from one another and offset from the first set of venturi nozzles 412 and the seventh set of venturi nozzles 424. The third set of venturi nozzles 416 and the fifth set of venturi nozzles 420 each contain six venturi nozzles 100 or 200 that are equally spaced apart from one another and offset from the second set of venturi nozzles 414 and the sixth set of venturi nozzles 422. The fourth set of venturi nozzles 420 contains four or five venturi nozzles 100 or 200 that are equally spaced apart from one another and offset from the third set of venturi nozzles 418 and the fifth set of venturi nozzles 422. A pilot light or igniter 426 may be attached, mounted or disposed on the the nozzle assembly 400. Other venturi nozzle configurations can be used as will be appreciated by those skilled in the art.

Figure 4D:
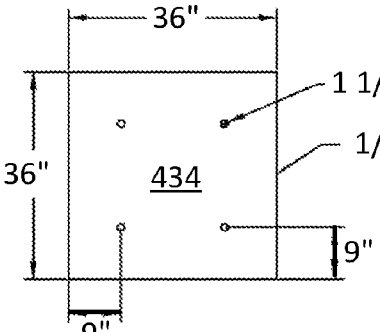

As shown in FIG. 4C, the nozzle assembly 400 is attached, mounted or disposed within a stack, chimney or vented enclosure 402 having a bottom 430 and a top 432. A base plate 434 is attached to the bottom 432 of the stack, chimney or vented enclosure 402, and a cap 436 is attached to the top 430 of the stack, chimney or vented enclosure 402. An example of base plate 434 is shown in FIG. 4D (e.g., 36"×36"×¼" with four 1 1/4" diameter holes set 9" from the exterior of the base plate). The stack, chimney or vented enclosure 402 will also typically include several sets of four guy eyelets 438, two couplings 440, and expanded metal or other venting below the cap 436. Note also that the dimensions shown in FIG. 4C are shown for illustrative purposes and do not limit the present invention.

Moreover, one or more gas recirculation tubes 442 (optional) can be connected to an upper portion of the stack, chimney or vented enclosure 402 and the gas inlet 408, or the gap 118 (as shown) of the venturi nozzles 100 or 200 or both. In addition, one or more gas capture units 444 (optional) can be installed within and extend into the stack, chimney or vented enclosure 402. The gas capture units 444 are proximate to the one or more recirculation tubes 442 in the upper portion of the stack, chimney or vented enclosure 402 to direct a portion of the flue or exhaust gas from the nozzle assembly 400 into the one or more recirculation tubes 442. Note also that the gas capture units 444 can be a vent wall along the entire inner perimeter of the stack, chimney or vented enclosure 402 that forms an annular space or gap between the vent wall and the interior surface of the the stack, chimney or vented enclosure 402 that captures a portion of the flue or exhaust gas and directs the gas into the gas recirculation tubes 442. (See U.S. Patent No. 8,657,919 which is hereby incorporated in its entirety).

Figure 5A:
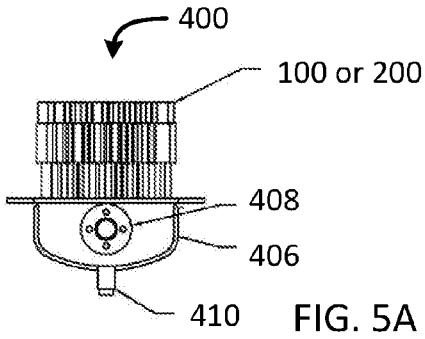
FIGS. 5A-5C are various views of two or more venturi nozzles combined together into a nozzle assembly or multi-nozzle gas combustor and attached, mounted or disposed within a stack, chimney or vented enclosure in accordance with yet another embodiment of the present invention.
Figure 5B:
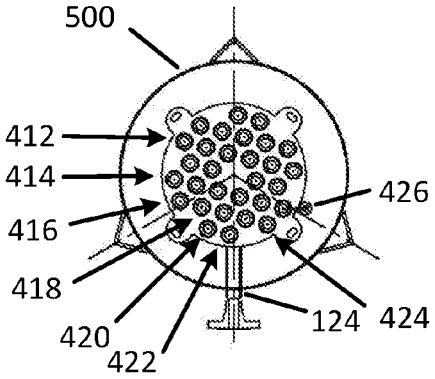
Figure 5C:
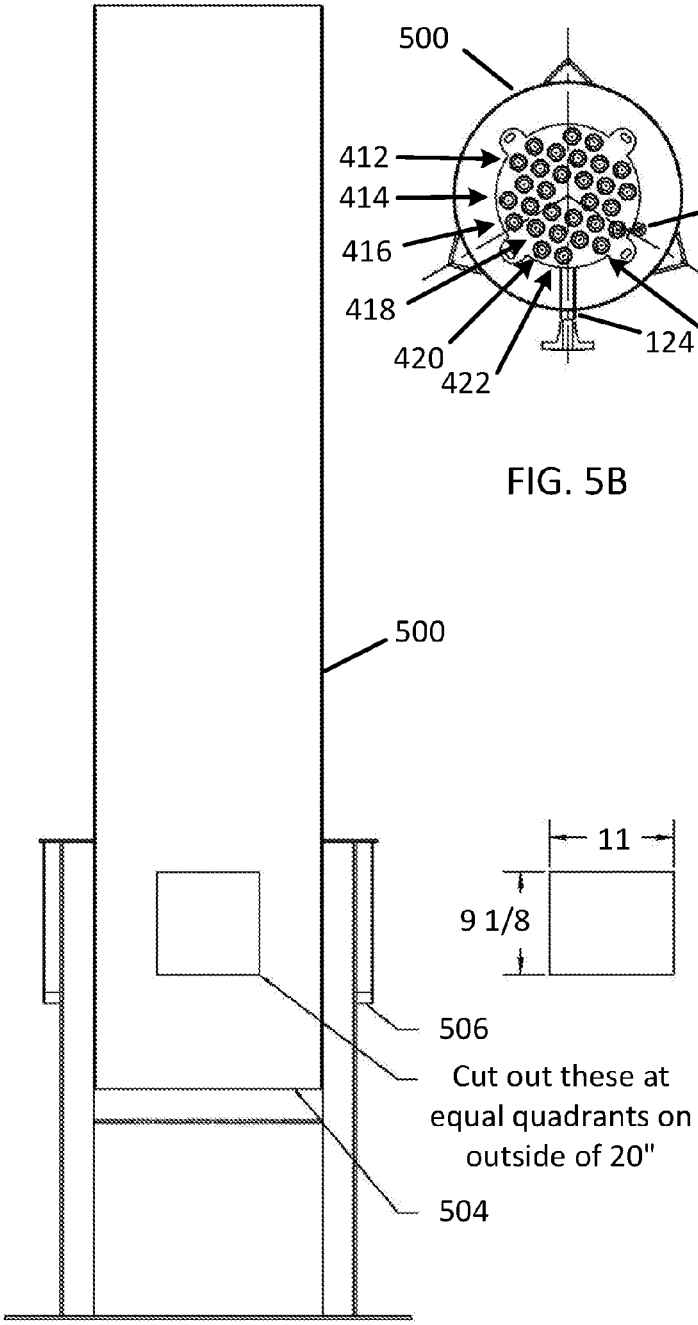

Referring now to FIGS. 5A-5C, two or more venturi nozzles 100 or 200 can be combined together into a nozzle assembly or multi-nozzle gas combustor 400 and attached, mounted or disposed within a stack, chimney or vented enclosure 500. As shown in FIG. 5C, the wall(s) of the stack, chimney or vented enclosure 500 may include one or more primary openings, cut outs or vents 504 to provide primary air 122 to the gap 118 of the venturi nozzles 100 or 200, and one or more secondary openings, cut outs or vents 506 to provide secondary air 126 to outside the exit of the venturi tube 104 to better complete combustion of the gas 120. As shown in FIGS. 5A and 5B, the nozzle assembly 400 includes a gas chamber 406 connected to the inlet 110 of each orificed gas nozzle 102. The gas chamber 406 has a gas inlet 408 and a drain 410. The two or more venturi nozzles 100 or 200 include a first set of venturi nozzles 412 connected to gas chamber 406, a second set of venturi nozzles 414 connected to the gas chamber 406, a third set of venturi nozzles 416 connected to the gas chamber 406, a fourth set of venturi nozzles 418 connected to the gas chamber 406, a fifth set of venturi nozzles 420 connected to the gas chamber 406, a sixth set of venturi nozzles 422 connected to the gas chamber 406 and a seventh set of venturi nozzles 424 connected to the gas chamber 406. The first set of venturi nozzle 412 and the seventh set of venturi nozzles 424 each contain two venturi nozzles 100 or 200 that are equally spaced apart from one another. The second set of venturi nozzles 414 and the sixth set of venturi nozzles 422 each contain five venturi nozzles 100 or 200 that are equally spaced apart from one another and offset from the first set of venturi nozzles 412 and the seventh set of venturi nozzles 424. The third set of venturi nozzles 416 and the fifth set of venturi nozzles 420 each contain six venturi nozzles 100 or 200 that are equally spaced apart from one another and offset from the second set of venturi nozzles 414 and the sixth set of venturi nozzles 422. The fourth set of venturi nozzles 420 contains four or five venturi nozzles 100 or 200 that are equally spaced apart from one another and offset from the third set of venturi nozzles 418 and the fifth set of venturi nozzles 422. A pilot light or igniter 426 may be attached, mounted or disposed on the the nozzle assembly 400. Other venturi nozzle configurations can be used as will be appreciated by those skilled in the art.

As illustrated in FIG. 4C, the stack, chimney or vented enclosure 500 of FIG. 5C may also include one or more gas recirculation tubes 442 (optional) connected to an upper portion of the stack, chimney or vented enclosure 500 and the gas inlet 408, or the gap 118 (as shown) of the venturi nozzles 100 or 200 or both. In addition, one or more gas capture units 444 (optional) can be installed within and extend into the stack, chimney or vented enclosure 500. The gas capture units 444 are proximate to the one or more recirculation tubes 442 in the upper portion of the stack, chimney or vented enclosure 500 to direct a portion of the flue or exhaust gas from the nozzle assembly 400 into the one or more recirculation tubes 442. Note also that the gas capture units 444 can be a vent wall along the entire inner perimeter of the stack, chimney or vented enclosure 500 that forms an annular space or gap between the vent wall and the interior surface of the the stack, chimney or vented enclosure 402 that captures a portion of the flue or exhaust gas and directs the gas into the gas recirculation tubes 442.

Figure 6A:
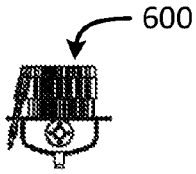
FIGS. 6A-6C are various views of two or more venturi nozzles combined together into a nozzle assembly or multi-nozzle gas combustor and attached, mounted or disposed within a stack, chimney or vented enclosure in accordance with yet another embodiment of the present invention.
Figure 6B:
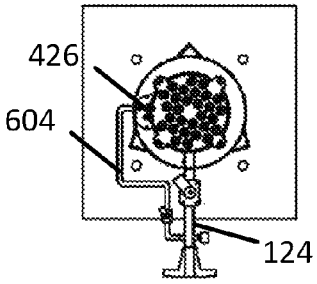
Figure 6C:
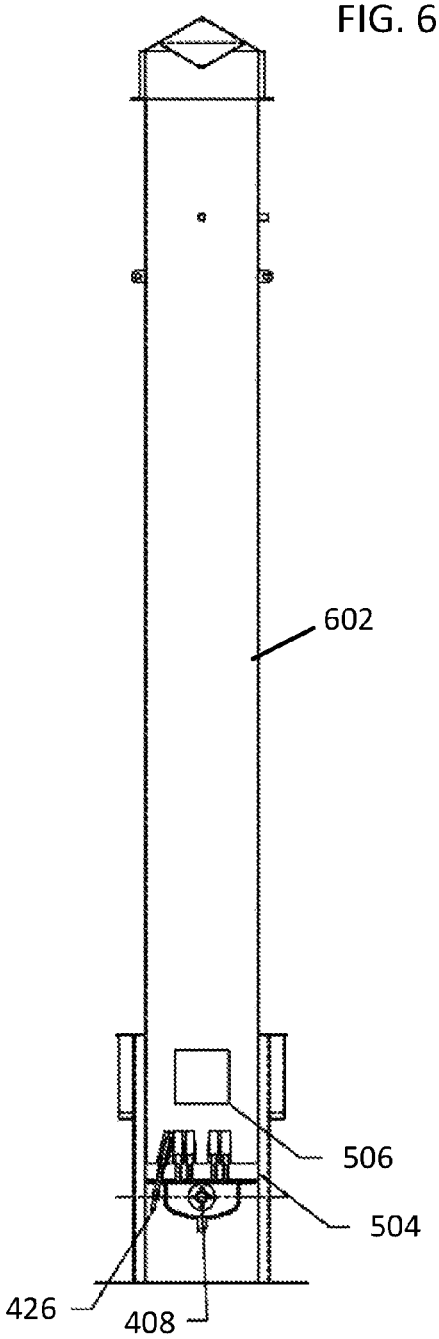

Referring now to FIGS. 6A-6C, two or more venturi nozzles 100 or 200 can be combined together into a nozzle assembly or multi-nozzle gas combustor 600 and attached, mounted or disposed within a stack, chimney or vented enclosure 602. As shown in FIG. 6C, the wall(s) of the stack, chimney or vented enclosure 602 may include one or more primary openings, cut outs or vents 504 to provide primary air 122 to the gap 118 of the venturi nozzles 100 or 200, and one or more secondary openings, cut outs or vents 506 to provide secondary air 126 to outside the exit of the venturi tube 104 to better complete combustion of the gas 120. As shown in FIGS. 6A and 6B, the nozzle assembly 600 is substantially as shown in FIGS. 4A and 5A. The pilot light or igniter 426 may be attached, mounted or disposed on the the nozzle assembly 600 and connected to the manifold 124 with line 604. Other venturi nozzle configurations can be used as will be appreciated by those skilled in the art.

As illustrated in FIG. 4C, the stack, chimney or vented enclosure 602 of FIG. 6C may also include one or more gas recirculation tubes 442 (optional) connected to an upper portion of the stack, chimney or vented enclosure 602 and the gas inlet 408, or the gap 118 (as shown) of the venturi nozzles 100 or 200 or both. In addition, one or more gas capture units 444 (optional) can be installed within and extend into the stack, chimney or vented enclosure 602. The gas capture units 444 are proximate to the one or more recirculation tubes 442 in the upper portion of the stack, chimney or vented enclosure 602 to direct a portion of the flue or exhaust gas from the nozzle assembly 600 into the one or more recirculation tubes 442. Note also that the gas capture units 444 can be a vent wall along the entire inner perimeter of the stack, chimney or vented enclosure 602 that forms an annular space or gap between the vent wall and the interior surface of the the stack, chimney or vented enclosure 402 that captures a portion of the flue or exhaust gas and directs the gas into the gas recirculation tubes 442.

Although preferred embodiments of the present invention have been described in detail, it will be understood by those skilled in the art that various modifications can be made therein without departing from the spirit and scope of the invention as set forth in the appended claims.

What is claimed is:

1. A venturi nozzle for a gas combustor comprising:

an orificed gas nozzle having a longitudinal axis, an inlet and an outlet having a larger diameter than the inlet;

a venturi tube aligned with the longitudinal axis and having an entrance proximate to the outlet of the orificed gas nozzle and an exit;

one or more support members attached between the orificed gas nozzle and the venturi tube that create a gap between an interior of the entrance of the venturi tube and an exterior of the outlet of the orificed gas nozzle; and wherein a gas exiting the outlet of the orificed gas nozzle provides a motive force that induces a flow of air into the entrance of the venturi tube that mixes with the gas within the venturi tube forming a gas-air mixture, and the gas-air mixture further mixes with an air outside the exit of the venturi tube when ignited to complete combustion of the gas.

2. The venturi nozzle as recited in claim 1, wherein the outlet of the orificed gas nozzle is either disposed within the entrance of the venturi tube or separated and spaced apart from the entrance of the venturi tube along the longitudinal axis.

3. The venturi nozzle as recited in claim 1, wherein the one or more support members comprise a tapered cylinder having two or more openings.

4. The venturi nozzle as recited in claim 1, wherein the gas-air mixture further comprises a flue or exhaust gas.

5. The venturi nozzle as recited in claim 1, further comprising a pilot or igniter disposed proximate to the exit of the venturi tube.

6. A multi-nozzle gas combustor comprising:

three or more venturi nozzles, each venturi nozzle comprising:

an orificed gas nozzle having a longitudinal axis, an inlet and an outlet having a larger diameter than the inlet, a venturi tube aligned with the longitudinal axis and having an entrance proximate to the outlet of the orificed gas nozzle and an exit, and one or more support members attached between the orificed gas nozzle and the venturi tube that create a gap between an interior of the entrance of the venturi tube and an exterior of the outlet of the orificed gas nozzle;

a main manifold;

one or more manifolds connected to the inlet of each orificed gas nozzle, wherein the one or more manifolds comprise a first branch manifold, a second branch manifold, a third branch manifold, a fourth branch manifold, and a fifth branch manifold, wherein all the branch manifolds are connected to the main manifold and are substantially equally spaced apart and parallel to one another;

the three or more venturi nozzles are equally spaced apart from one another and arranged in at least two sets that are offset from one another;

the at least two sets comprise a first set of venturi nozzles connected to the first branch manifold, a second set of venturi nozzles connected to the second branch manifold, a third set of venturi nozzles connected to the third branch manifold, a fourth set of venturi nozzles connected to the fourth branch manifold, a fifth set of venturi nozzles connected to the fifth branch manifold;

the first set of venturi nozzles, the third set of venturi nozzles and the fifth set of venturi nozzles each contain five venturi nozzles that are equally spaced apart from one another; and the second set of venturi nozzles and the fourth set of venturi nozzles each contain six venturi nozzles that are equally spaced apart from one another and offset from the first set of venturi nozzles, the third set of venturi nozzles and the fifth set of venturi nozzles.

7. The multi-nozzle gas combustor as recited in claim 6, wherein the outlet of the orificed gas nozzle is either disposed within the entrance of the venturi tube or separated and spaced apart from the entrance of the venturi tube along the longitudinal axis.

8. The multi-nozzle gas combustor as recited in claim 6, wherein the one or more support members comprise a tapered cylinder having two or more openings.

9. The multi-nozzle gas combustor as recited in claim 6, wherein a gas exiting the outlet of the orificed gas nozzle provides a motive force that induces a flow of air into the entrance of the venturi tube that mixes with the gas within the venturi tube forming a gas-air mixture, and the gas-air mixture further mixes with an air outside the exit of the venturi tube when ignited to complete combustion of the gas.

10. The multi-nozzle gas combustor as recited in claim 9, wherein the gas-air mixture further comprises a flue or exhaust gas.

11. The multi-nozzle gas combustor as recited in claim 6, further comprising a pilot or igniter disposed proximate to the exit of the venturi tube of one of the venturi nozzles.

12. The multi-nozzle gas combustor as recited in claim 6, wherein the multi-nozzle gas combustor is disposed within a stack, chimney or vented enclosure.

13. The multi-nozzle gas combustor as recited in claim 12, further comprising one or more primary air openings, cut outs or vents within a wall of the stack, chimney or vented enclosure that provide a primary air to the multi-nozzle gas combustor.

14. The multi-nozzle gas combustor as recited in claim 12, further comprising one or more secondary air openings, cut outs or vents within a wall of the stack, chimney or vented enclosure that provide a secondary air to the multi-nozzle gas combustor.

15. A burner system comprising:

a stack, chimney or vented enclosure having a top and a bottom;

a multi-nozzle gas combustor disposed within and proximate to the bottom of the stack, chimney or vented enclosure, the multi-nozzle gas combustor comprising:

three or more venturi nozzles, each venturi nozzle comprising an orificed gas nozzle having a longitudinal axis, an inlet and an outlet having a larger diameter than the inlet, a venturi tube aligned with the longitudinal axis and having an entrance proximate to the outlet of the orificed gas nozzle and an exit, and one or more support members attached between the orificed gas nozzle and the venturi tube that create a gap between an interior of the entrance of the venturi tube and an exterior of the outlet of the orificed gas nozzle, one or more manifolds or a gas chamber connected to the inlet of each orificed gas nozzle, and the three or more venturi nozzles are equally spaced apart from one another and arranged in at least two sets that are offset from one another; and one or more gas recirculation tubes connected to an upper portion of the stack, chimney or vented enclosure and the gas inlet, the gap or both.

16. The burner system as recited in claim 15, further comprising one or more primary air openings, cut outs or vents within a wall of the stack, chimney or vented enclosure that provide a primary air to the multi-nozzle gas combustor.

17. The burner system as recited in claim 15, further comprising one or more secondary air openings, cut outs or vents within a wall of the stack, chimney or vented enclosure that provide a secondary air to the multi-nozzle gas combustor.

18. The burner system as recited in claim 15, further comprising one or more gas capture units that extend into the stack, chimney or vented enclosure and are attached to the one or more recirculation tubes in the upper portion of the stack, chimney or vented enclosure.

19. The burner system as recited in claim 18, wherein the one or more gas capture units comprise a vent wall along an entire inner perimeter of the stack, chimney or vented enclosure that forms an annular space or gap between the vent wall and an interior surface of the stack, chimney or vented enclosure.

20. The burner system as recited in claim 15, wherein the outlet of the orificed gas nozzle is either disposed within the entrance of the venturi tube or separated and spaced apart from the entrance of the venturi tube along the longitudinal axis.

21. The burner system as recited in claim 15, wherein the one or more support members comprise a tapered cylinder having two or more openings.

22. The burner system as recited in claim 15, wherein a gas exiting the outlet of the orificed gas nozzle provides a motive force that induces a flow of air into the entrance of the venturi tube that mixes with the gas within the venturi tube forming a gas-air mixture, and the gas-air mixture further mixes with an air outside the exit of the venturi tube when ignited to complete combustion of the gas.

23. The burner system as recited in claim 22, wherein the gas-air mixture further comprises a flue or exhaust gas.

24. The burner system as recited in claim 15, further comprising a pilot or igniter disposed proximate to the exit of the venturi tube of one of the venturi nozzles.

* * * * *